US007749138B2

(12) United States Patent
Wang

(10) Patent No.: US 7,749,138 B2
(45) Date of Patent: Jul. 6, 2010

(54) INTEGRATED FOLDING MECHANISM OF A TREADMILL

(76) Inventor: Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 174 days.

(21) Appl. No.: 11/980,053

(22) Filed: Oct. 31, 2007

(65) Prior Publication Data

US 2009/0111665 A1 Apr. 30, 2009

(51) Int. Cl.
*A63B 22/02* (2006.01)

(52) U.S. Cl. ..... 482/54

(58) Field of Classification Search ..... 482/51, 482/54; 119/700; *A63B 22/02*
See application file for complete search history.

(56) References Cited

U.S. PATENT DOCUMENTS 5,279,528 A * 1/1994 Dalebout et al. ..... 482/54
5,733,228 A * 3/1998 Stevens ..... 482/54
7,537,549 B2 * 5/2009 Nelson et al. ..... 482/54
2003/0125166 A1 * 7/2003 Chang ..... 482/54
2004/0132585 A1 * 7/2004 Chen ..... 482/54
2004/0152564 A1 * 8/2004 Kuo ..... 482/54
2006/0122037 A1 * 6/2006 Chou Lin ..... 482/54
2007/0191190 A1 * 8/2007 Kuo ..... 482/54
2008/0312046 A1 * 12/2008 Lin et al. ..... 482/54
2009/0069159 A1 * 3/2009 Wang ..... 482/54
2009/0093347 A1 * 4/2009 Wang ..... 482/54
2009/0124465 A1 * 5/2009 Wang ..... 482/54

* cited by examiner

*Primary Examiner*—Loan H Thanh
*Assistant Examiner*—Oren Ginsberg

(57) ABSTRACT

An integrated folding mechanism of a treadmill having a slide pusher supported by a pneumatic cylinder at the bottom of a platform frame thereof. In this way, the rear support may be pushed upward to bring the platform frame in a vertical stable folding position or in a flat ground-touching position when the platform frame is moved upward and downward. Meanwhile, the rear support is provided with a push rod opposing to the handrail assembly. The push rod is adapted to push a coupling cross shaft having a rotation disc at both sides thereof, respectively. In this way, the handrail assembly fixed coaxially to the rotation discs can be synchronically moved in a flat position or in an upright position.

1 Claim, 4 Drawing Sheets

INTEGRATED FOLDING MECHANISM OF A TREADMILL

BACKGROUND OF THE INVENTION

1. Fields of the Invention

The invention relates to an integrated folding mechanism of a treadmill, and more particularly, to a folding mechanism that provides an excellent auxiliary and supporting force when the platform frame is moved upward in a folded position and downward in a flat position. Meanwhile, a handrail assembly is movable to create a synchronic folding and extending action.

2. Description of the Related Art

As well-known, the treadmill has a large volume and a great weight. It is therefore common to provide the platform frame of the treadmill with a fold-up function for facilitating the transportation and the storage. In view of the basic accessories of the treadmill, the fold-up mechanism can be divided into an electric and a manual folding configuration. The invention is intended for the manual folding configuration.

In fact, the conventional treadmills are not able to provide an excellent auxiliary supporting force for helping the operator to complete the fold-up or fold-down process when the platform frame is moved either in a storage position or in an operation position. Thus, the women often regard the fold-up or fold-down process of the treadmill as an impossible mission because any careless action would cause injuries to the body.

The worry about the above-mentioned operation of the treadmill can be attributed to the improper or insufficient design of the treadmill in addition to the bulky platform frame. This is the key point of the problems.

SUMMARY OF THE INVENTION

It is a primary object of the invention to eliminate the above-mentioned drawbacks and to provide a folding mechanism of a treadmill that employs a pneumatic cylinder and a slide pusher to provide an effective auxiliary and supporting force when the platform frame is moved in a vertical position or in a horizontal position. Meanwhile, the handrail assembly can be moved with the platform frame under the influence of the rear support, the push rod, the coupling cross shaft and the rotation discs. In this way, the handrail assembly can be synchronically moved in a flat position or in an upright position. This is the primary object of the invention.

According to the invention, a folding mechanism of a treadmill includes a slide pusher supported by a pneumatic cylinder at the bottom of a platform frame thereof, thereby pushing the rear support in an opposing direction to keep a ground-touching slide action at all times. In addition, the rear support is provided with a push rod opposing to the handrail assembly. The push rod is adapted to push a coupling cross shaft having a rotation disc at both sides thereof, respectively. In this way, the handrail assembly fixed coaxially to the rotation discs can be synchronically moved in a flat position or in an upright position.

DETAILED DESCRIPTION OF THE PREFERRED EMBODIMENT

The present invention will now be described in more detail hereinafter with reference to the accompanying drawings that show various embodiments of the invention.

Figure 1:
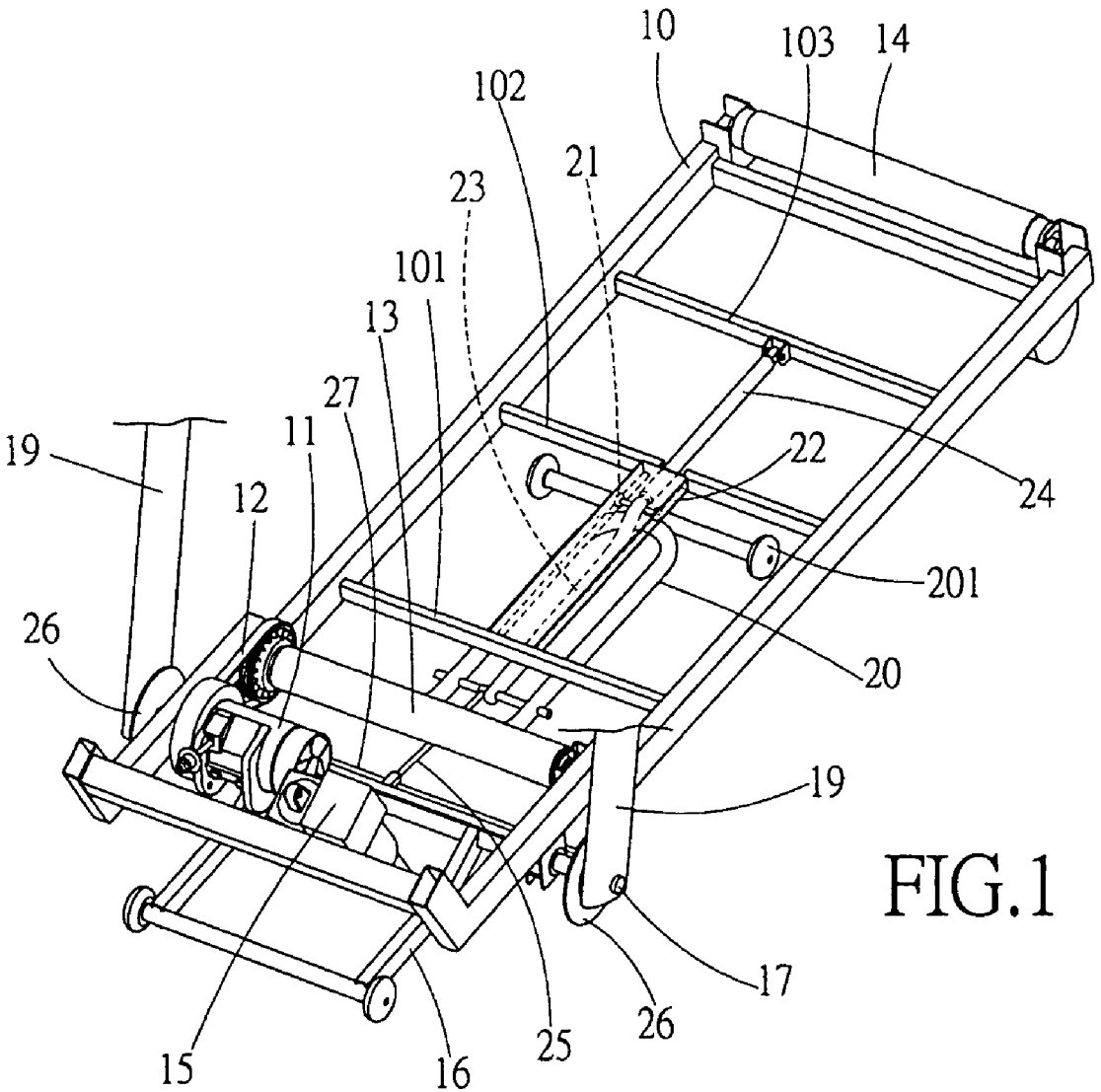
FIG. 1 is a perspective view of a preferred embodiment of the invention.
Figure 2:
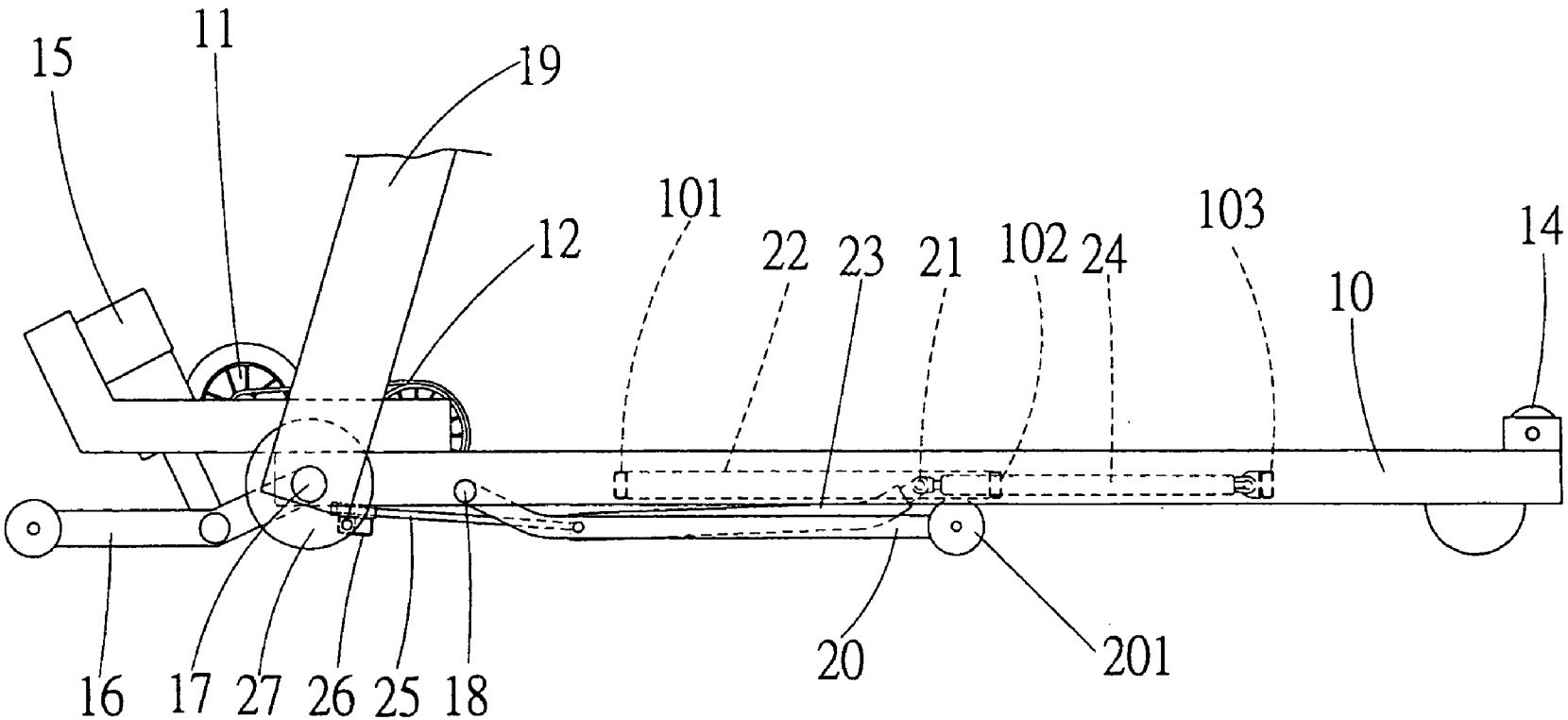
FIG. 2 is a side view of FIG. 1.

Referring to FIGS. 1 and 2, a platform frame 10 includes a transmission motor 11 at one side thereof for driving a continuous moving belt (not shown) into rotation by use of a transmission belt 12, a front roller 13, and a rear roller 14. Meanwhile, a lifting motor 15 is employed to move an adjusting support 16 upward and downward for adjusting the supporting angle of the platform frame 10. Moreover, two connection pins 17, 18 are disposed at both sides of the platform frame 10, respectively, for pivotally coupling a handrail assembly 19 and a rear support 20, respectively.

The first and the second strengthening bars 101, 102 of the platform frame 10 are provided with a slide rail 22 on which the slipper 21 moves. The slipper 21 and a slide pusher 23 are attached to each other. Meanwhile, the other end of the slide pusher 23 is pivotally coupled to a certain position of the rear support 20. Moreover, a third strengthening bar 103 of the platform frame 10 is pivotally connected with a pneumatic cylinder 24 while the other end of the pneumatic cylinder 24 directly pushes the slide pusher 23.

Figure 3:
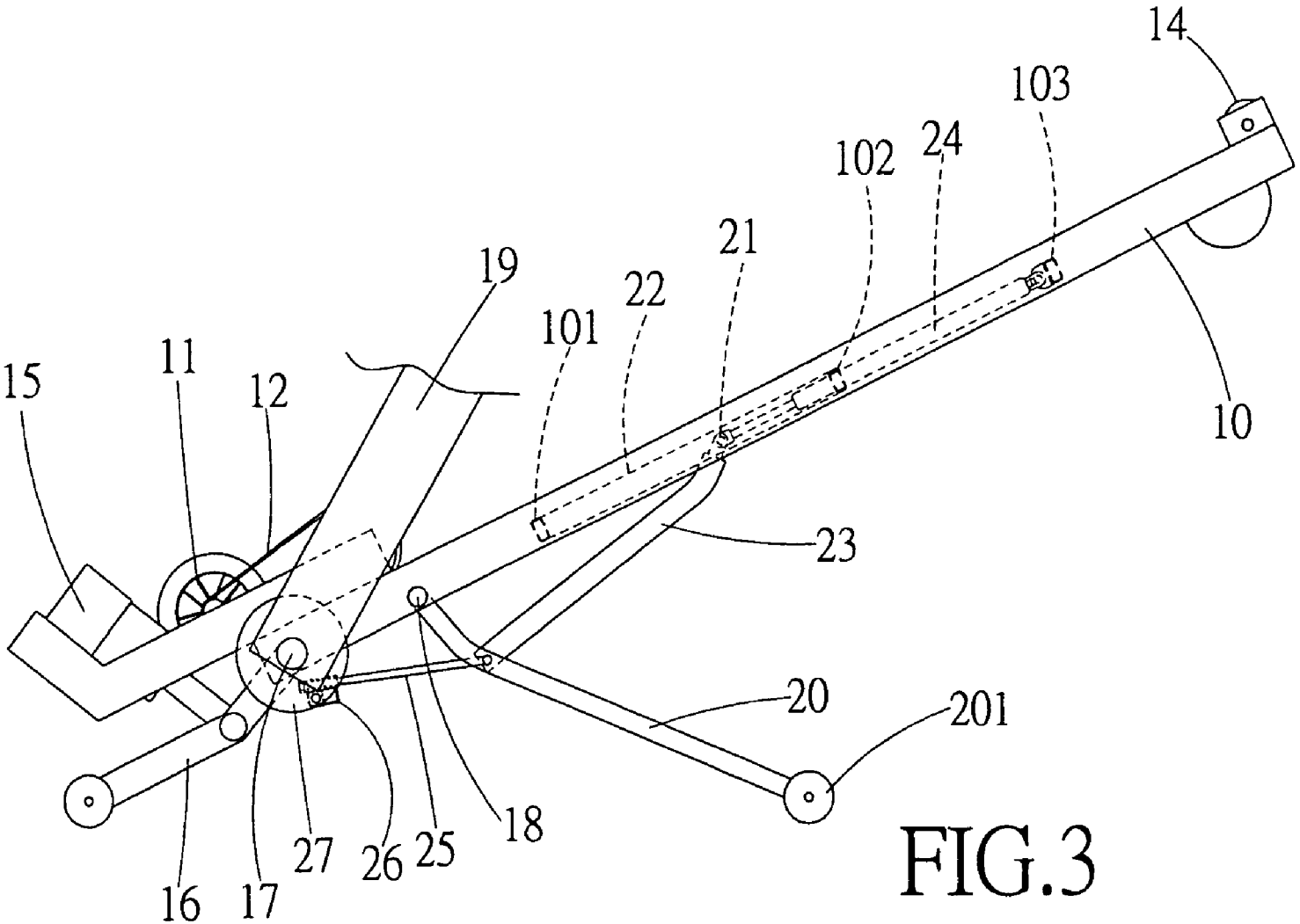
FIG. 3 is a side view of FIG. 1 with the treadmill's platform lifted in an inclined position.
Figure 4:
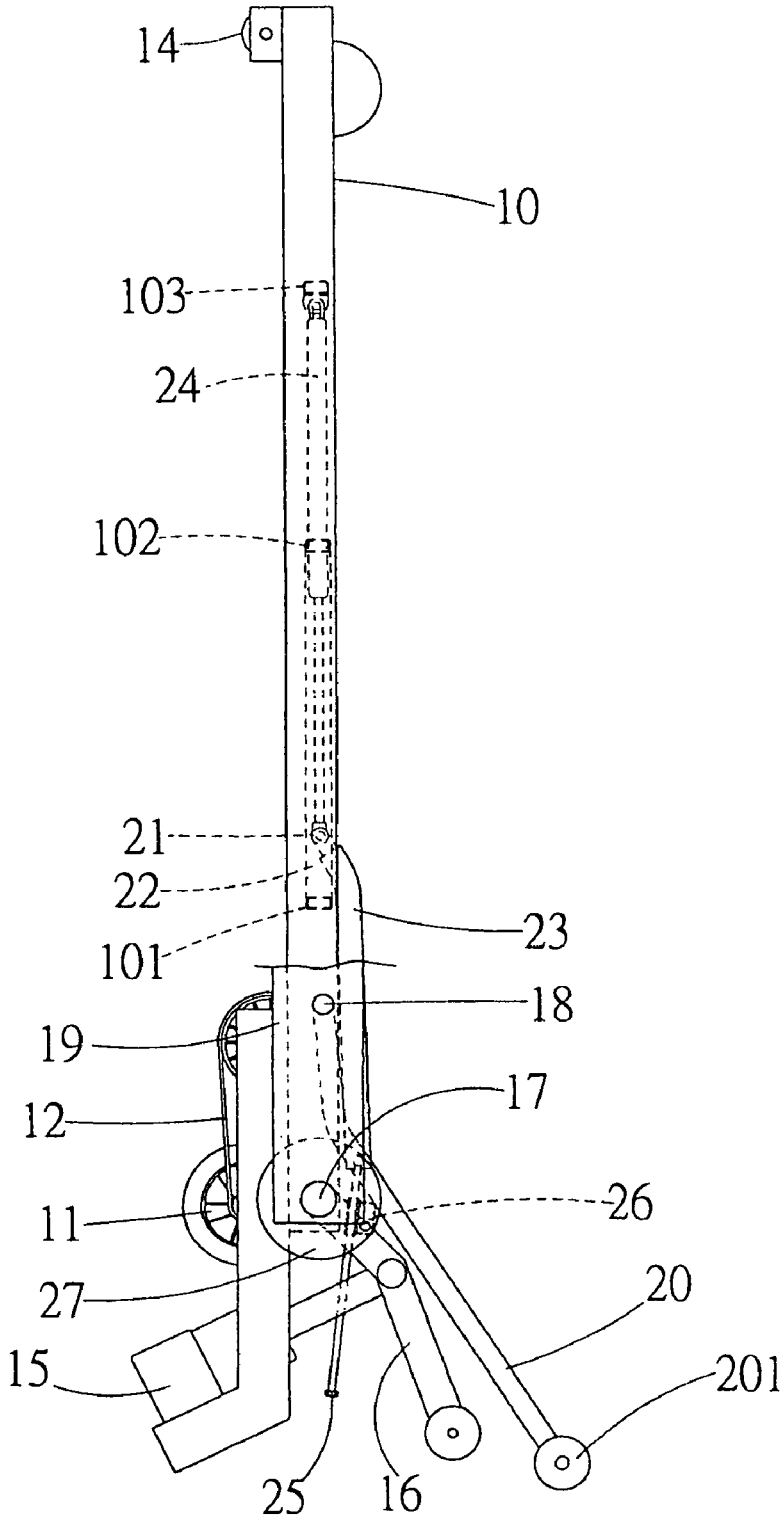
FIG. 4 is a side view of FIG. 1 with the treadmill's platform lifted in a storage position.

Thereafter, the rear support 20 is provided with a push rod 25 opposing to the handrail assembly 19. The push rod 25 is adapted to push a coupling cross shaft 27 having a rotation disc 26 at both sides thereof, respectively. In this way, the handrail assembly 19 fixed coaxially to the rotation discs 26 can be synchronically moved in a flat position or in an upright position As shown in FIGS. 3 and 4, the pneumatic cylinder 24 is brought into a compressed state by the weight of the platform frame 10 when the platform frame 10 is moved in a horizontal operation position. The pneumatic cylinder 24 provides an auxiliary supporting force to push the slide pusher 23 toward the front end of the platform frame 10 when the operator lifts the rear end of the platform frame 10. In this way, the rear support 20 may be also pushed toward the front end of the platform frame 10 for a ground-touching rotation until the platform frame 10 is moved in a vertical storage position.

Likewise, the guide wheels 201 of the rear support 20 are also brought into a ground-touching rotation under the influence of the shock mitigation provided by the pneumatic cylinder 24 when the platform frame 10 is compressed downward until the platform frame 10 is moved in a horizontal position. Accordingly, a stable and effort-saving effect is achieved.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An integrated folding mechanism of a treadmill having a platform frame with a transmission motor at one side thereof for driving a continuous moving belt into rotation by use of a transmission belt, a front roller, and a rear roller, a lifting motor being employed to move an adjusting support upward and downward for adjusting the supporting angle of the platform frame, two connection pins being disposed at both sides of the platform frame, respectively, for pivotally coupling a handrail assembly and a rear support, respectively, wherein first and second strengthening bars extend across a width of the platform frame, wherein a slide rail, on which a slipper moves, extends between the first and second strengthening bars of the platform frame;

wherein a slide pusher is attached to the slipper while the other end of the slide pusher is pivotally coupled to the rear support;

wherein a pneumatic cylinder is pivotally connected with a third strengthening bar of the platform frame while the other end of the pneumatic cylinder directly pushes the slide pusher; and wherein a push rod is provided on the rear support opposing to the handrail assembly while the push rod is adapted to push a coupling cross shaft having a rotation disc at both sides thereof, respectively, in this way, the handrail assembly fixed coaxially to the rotation discs can be synchronically moved in a flat position or in an upright position, wherein the slide rail extends both above and substantially parallel to the rear support, when the treadmill is in an unfolded state.

* * * * *